United States Patent [19]

Åhs

[11] Patent Number: 4,941,970

[45] Date of Patent: Jul. 17, 1990

[54] APPARATUS FOR DIVIDING A SUSPENSION OF FIBROUS CELLULOSE PULP

[75] Inventor: Björn Åhs, Karlstad, Sweden

[73] Assignee: Kamyr AB, Karlstad, Sweden

[21] Appl. No.: 207,215

[22] Filed: Jun. 16, 1988

[30] Foreign Application Priority Data

Jul. 3, 1987 [SE] Sweden ..... 8702745

[51] Int. Cl.[5] ..... B07B 1/00; B07B 1/24

[52] U.S. Cl. ..... 209/234; 209/270; 241/46.17

[58] Field of Search ..... 209/270, 271, 234, 273, 209/268, 12, 285, 286, 290, 293; 241/46.17, 69, 79.1; 162/55, 261

[56] References Cited

U.S. PATENT DOCUMENTS

| | | | |
|---|---|---|---|
| 1,183,297 | 5/1916 | Haug | 209/270 |
| 1,946,511 | 2/1934 | Van Pelt | 209/270 X |
| 3,223,239 | 12/1965 | Dick | 209/270 |
| 3,404,065 | 10/1968 | Ingemarsson | 209/270 X |
| 4,231,881 | 11/1980 | Ingemarsson | 210/396 |
| 4,303,508 | 12/1981 | Skretting | 209/297 |
| 4,680,108 | 7/1987 | Ahs | 209/273 |
| 4,737,274 | 4/1988 | Jacobsen et al. | 209/268 |

*Primary Examiner*—Donald T. Hajec

*Attorney, Agent, or Firm*—Nixon & Vanderhye

[57] ABSTRACT

In an apparatus for dividing a suspension of fibrous cellulose pulp into a plurality of portions, a closed housing is provided which is divided into two chambers, each provided with at least one inlet and outlet, and in the first chamber a separating device is arranged, rotating at high speed, to separate undesired parts from the suspension via an outlet. An inlet to the second chamber is provided in the form of an opening between the first chamber and the second chamber for transferring the suspension which has been substantially freed from undesired parts. Furthermore, in the second chamber a cylindrical screening device is arranged, connected to the separating device in the first chamber, the separating device and screening device being driven by a common shaft. A support provided with blades cooperates with the screening means to divide the suspension into different fractions which leave the second chamber by individual outlets.

17 Claims, 2 Drawing Sheets

APPARATUS FOR DIVIDING A SUSPENSION OF FIBROUS CELLULOSE PULP

FIELD AND BACKGROUND OF THE INVENTION

The present invention relates to an apparatus for dividing a suspension of fibrous cellulose pulp into a plurality of portions in a closed housing having inlet and outlet means.

In the production of fibrous cellulose pulp impurities are supplied from outside as well as through deficiencies during the actual manufacturing process. These undesired parts may vary in size and consist for instance of sand particles, gravel, stones, nuts, parts of welding electrodes and pieces of metal. It is therefore necessary to remove such undesired parts, especially from suspensions which are to be processed further in machines and equipments which are sensitive and may be damaged by such solid parts, or which for other reasons must as far as possible be freed from impurities. Various types of devices have been suggested for separating undesired solid parts from a fibrous cellulose pulp, see e.g. patent specifications SE 7903032-6 (corresponding to U.S. Pat. No. 4,303,508), SE 8503372-8 (corresponding to U.S. patent application Ser. No. 882,716) and U.S. Pat. No. 4,231,881.

In order to be able to subject a fibrous cellulose pulp of medium concentration, i.e. about 6–15%, a screening operation, a screening device must be used which generates pulsations and shearing forces in the pulp so that it is fluidized, i.e. it is transferred to an easy flowing condition, and the fibres can then move in relation to each other. A part-flow of finer fibrous material (accept) and a part-flow of coarser material (reject) can thus be obtained through screening. A screening device based on the above principle is described in SE 8501030-4 (corresponding to U.S. patent application Ser. No. 836,123).

SUMMARY OF THE INVENTION

The object of the present invention is to provide an apparatus which forms a compact, multi-functional construction unit for the continuous separation of undesired parts of the type specified and also the division of the suspension into a fine fraction (accept) and a coarse fraction (reject}. Furthermore, the apparatus provides improved screening effect in comparison with a screening device of known type as described above. It is also an important object of the invention to provide a multi-functional apparatus which, in comparison with the combined use of two separate apparatus, each with its own function (separation and screening, respectively), simplifies driving and the drive equipment, simplifies installation and reduces control, regulation and safety equipments, with a consequent reduction in operation, installation and apparatus costs.

The above objects are achieved according to the present invention in that the closed housing is divided into two chambers, each provided with inlet and outlet means, that in the first chamber a separating means is arranged, rotating at high speed, to separate undesired parts from the suspension via an outlet, that an opening is arranged between the first chamber and the second chamber to transfer the suspension which has been substantially freed from undesired parts, and that in the second chamber a cylindrical screening means is arranged, connected to the separating means in the first chamber, the separating means and screening means being driven by a common shaft, and a support means provided with blades, with which the screening means cooperates to divide the suspension into different fractions which leave the second chamber by individual outlets. The different fractions may consist of a finer fraction (accept) and a courser fraction (reject).

BRIEF DESCRIPTION OF THE DRAWINGS

A preferred embodiment of the invention will be described further with reference to the accompanying drawing.

DETAILED DESCRIPTION OF THE DRAWINGS

Figure 1:
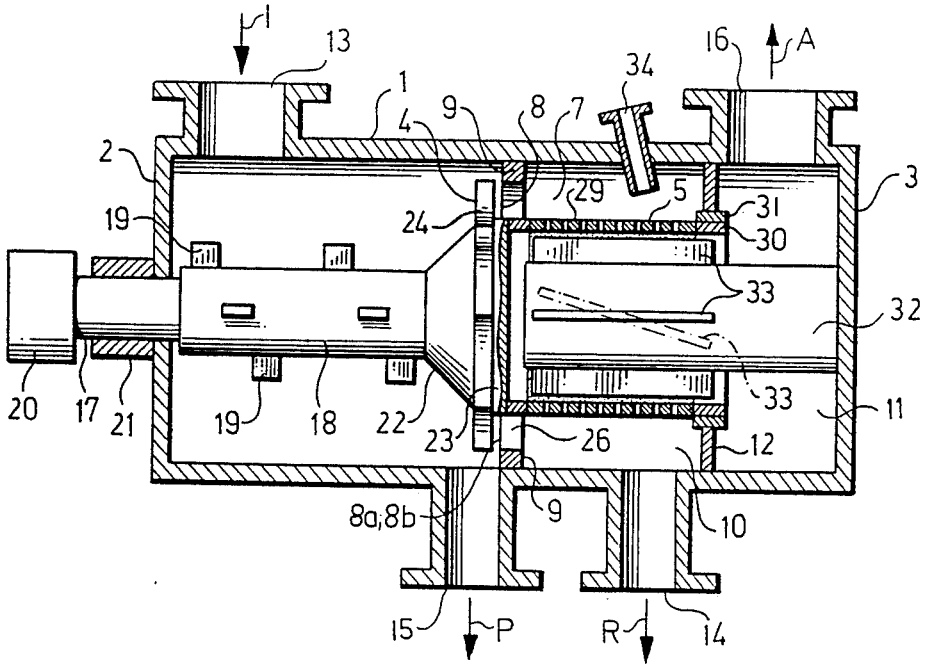
FIG. 1 shows schematically an apparatus according to the present invention in longitudinal section.

The apparatus shown schematically in FIG. 1 comprises a cylindrical housing 1 which is closed at each end by end walls 2, 3. The housing 1 is common to both a separating means 4 for separating undesired solid parts or particles from a suspension of fibrous cellulose pulp, and a screening means 5 for screening the suspension. The housing 1 is divided into a first chamber 6 for the separating means 4 and a second chamber 7 for, inter alia, the screening means 5, the chambers 6 and 7 communicating with each other via an opening in the form of an annular slot 8 of predetermined size. A ring 9 rigidly attached in the housing 1 thus forms the boundary between the two chambers 6 and 7, the inner circumference of the ring 9 thus forming the outer circumference of the annular slot 8. The second chamber 7 is in turn divided into an annular space 10 surrounding the screening means 5, and an accept space 11 extending from the interior of the screening means 5, out towards the end wall 3. The two spaces 10 and 11 are separated by a flat ring 12 as well as by the screening means 5.

The housing 1 is provided with an inlet 13 to the first chamber 6, for the suspension I to be treated (inject), and an outlet 14 from the second chamber 7, for the material R remaining after screening (reject). In the embodiment shown the inject inlet 13 is arranged radially in the cylindrical housing 1. Alternatively it may be arranged tangentially or axially spaced from the centre line of the housing. Furthermore, the housing 1 is provided with an outlet 15 from the first chamber 6, for undesired parts which may be designated solid impurities P. The housing is also provided with an accept outlet 16 in connection to the accept space 11. The annular slot 8 forms an outlet **8*a* from the first chamber 6 and a corresponding inlet 8*b* to the second chamber 7**.

Further, the apparatus comprises a horizontal, rotatable shaft 17 extending through the end wall 2 and into the first chamber 6 to carry the separating means 4 and also the screening means 5. The shaft 17 also carry an elongate rotor which is located in the first chamber 6 and is provided with a plurality of radial blades 19, arranged to function as stirrers. The shaft 17 with associated rotor 18, separating means 4 and screening means 5, is driven by a motor 20, shown schematically, and is supported by a bearing unit 21, also shown schematically, provided with suitable sealing means at the end wall 2 to seal between the housing and the shaft.

Between the rotor 18 and separating means 4 is a conical section 22, which serves to guide the suspension in the direction towards the periphery of the separating means 4, secured to the conical section 22. A flat, circular disc 23 is arranged on the shaft 17 inside the separating means 4 and secured thereto. The outer circumference of the disc 23 forms the inner circumference of said annular slot 8. In other words, the annular slot 8 is defined outwardly by the ring 9 and inwardly by the disc 23.

Figure 3:
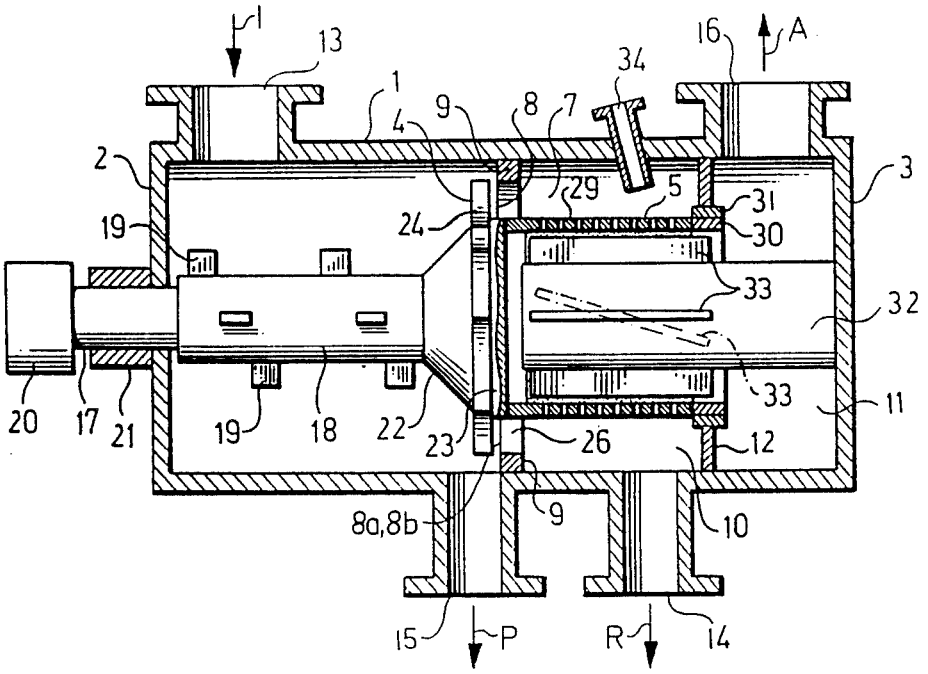
FIG. 3 is a view similar to FIG. 1 but showing an alternative embodiment of the invention.

Alternatively, the inner circumference of the slot 8 may be defined by an extension of the screening means 5 as shown in FIG. 3.

The separating means 4 consists of a flat disc element having a plurality of projections in the form of teeth 24, cogs or the like extending substantially radially (see FIG. 2), said teeth and the spaces 25 defined between them to allow the suspension through during rotation of the disc element 4, are axially aligned with the annular slot 8. The radial extension of the slot 8 is slightly less than, and lies within, the radial extension of the teeth 24, i.e a circle drawn through the top of the teeth 24 with the shaft 17 as its centre, suitably has a diameter slightly larger than the inner diameter of the ring 9 (corresponding to the diameter of the ring opening 26), and a circle drawn through the base of the teeth 24 has a diameter which is suitably slightly less than the diameter of the disc 23. The disc element 4 is mounted as close to the ring 9 as possible so that the outlet available for the flow of the suspension to the second chamber 7 will be formed mainly by the rotating spaces 25 between the teeth 24. The distance between the disc element 4 and the ring 9 is generally less than is shown in the drawing. Said outlet 15 for solid parts which are hit by the rotating teeth 24 and thus removed from the suspension, is located in the plane of the disc element 4 and on the lower side of the housing 1.

Figure 2:
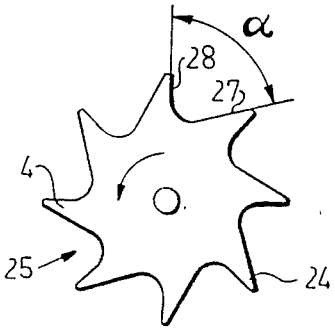
FIG. 2 shows a suitable embodiment of a toothed disc element mounted in the apparatus.

A suitable embodiment of a toothed disc.element 4 is shown in FIG. 2 where the direction of rotation is indicated by an arrow. The foremost edge 27 of a tooth 24 seen in the direction of rotation, forms an angle $\alpha$ with the rear edge 28 of the tooth immediately in front, which is suitably radial. The angle $\alpha$ may suitably be from 60° to 75° so that during its rotation in the direction of the arrow, the disc element 4 throws the undesired solid parts outwards and obliquely backwards, these impurities thus being prevented from passing axially or transversely through the disc element 4. The separated impurities may also include knots or largish pieces of wood. However, the main portion of these naturally occurring impurities will accompany the final reject.

The outlet 15 for the solid parts P is connected to a suitable device (not shown) for collecting and removing the solid parts separated from the suspension. Liquid, normally water, may be supplied to this device in order to create a small counterflow of liquid through the device so that it is not filled with fibres from the suspension, but will contain substantially the undesired solid parts removed therefrom.

The screening means 5 is arranged in the vicinity of the ring 9 and consists in the embodiment shown of a cylindrical, basket-like screening plate 29 provided with suitable openings in the form of holes or slots to screen off a finer fraction, known as the accept A. The screening cylinder surrounds the inner part of the accept chamber 11, in which the accept screened off is collected. The accept is then removed via an accept outlet 16. Arranging the annular slot 8 in line with the space 10 ensures a uniform distribution of suspension around the screening cylinder 29.

The screening cylinder 29 is provided with a bearing ring 30 at the opposite end to the disc element 4, said bearing ring cooperating externally with a corresponding bearing ring 31 attached to the ring 12 closing the accept space 11. Thus, when the shaft 17 rotates, the screening cylinder 29 is also arranged to rotate in the second chamber 7 at the same time as the disc element 4 rotates in the first chamber 6, since the screening cylinder 29, disc element 4 and shaft 17 (and also the rotor 18 and conical portion) form a rotating unit.

A cylindrical support body 32 is centrally rigidly attached to the end wall 3 of the housing by the accept outlet 16, and extends axially through the centre of the screening cylinder 29. The support body 32 has a smaller diameter than the screening cylinder, said inner part of the accept space 11 thus being formed between them with sufficient axial extension to receive the accept pressed through the screening cylinder and also to contain a plurality of stationary, elongate blades 33, attached to the support body 32 and extending substantially axially along this. Alternatively the blades may be inclined, as indicated by broken lines in FIG. 1, for instance. The blades are directed radially to provide a suitable small distance to the inner screening surface of the screening cylinder 29 to allow the screening cylinder to rotate freely without coming into contact with the stationary blades 33. In the embodiment shown four blades 33 are arranged on the support body 32, but the number may vary depending on the capacity of the apparatus, the screening properties of the suspension, etc. If inclined blades are used they should be directed in suitable manner so as to give the accept a favourable feed effect. The accept is then guided axially towards the end wall 3 as the screening cylinder rotates around the stationary blades 33.

The apparatus is also preferably provided with an inlet means 34 for the supply of diluting liquid to the second chamber 7, i.e. to the inject side of the screening cylinder 29, with the object of washing fibres away from the reject so that as little useful fibres as possible accompanies the reject and is instead caused to pass through the screening cylinder as accept. In the embodiment shown the inlet means 34 is a pipe connection extending through the wall of the housing 1 to the annular space 10, close to the downstream end thereof and thus spaced from the upstream end located closest to the ring 9. The pipe connection is suitably inclined as shown and is arranged substantially diametrically opposite the reject outlet 14. Alternatively several pipe connections may be distributed around the inject side of the screening cylinder.

The apparatus according to the invention can consequently be termed as a multi-functional construction unit due to the fact that in one and the same housing, and utilizing the same drive source and drive shaft, it is possible to perform continuous separation of impurities and, immediately thereafter, a continuous division of the suspension into at least one accept flow and one reject flow.

The suspension I flowing into the apparatus under pressure, is forced outwardly to the annular slot 8 in order to pass through it, the cross section area of the inject inlet 13 being considerably greater than the cross section area of the annular slot 8, so that the suspension is forced to accelerate to a higher speed while at the same time fluidizing. This is particularly important when the fibre pulp is of medium concentration. As the disc element rotates in front of the slot 8, its teeth 24 will generate shearing forces in the suspension so that it becomes fluidized, i.e. easy flowing. Since the disc element 4 is located close to the annular slot 8 the suspension will enter the second chamber 7 in fluidized form. The shearing forces to which the accept is subjected between the blades 33 and screening cylinder 5 during rotation of the cylinder are also valuable in maintaining the fluidizing condition so that the accept can be fed more easily from the screening cylinder.

During rotation of the screening cylinder 5 the blades 33 will create pressure pulses in the suspension which, besides having a fluidizing effect also have a cleaning effect on the screening cylinder, keeping the openings clear. During operation the apparatus is completely filled with pulp suspension flowing through the two chambers under pressure.

Other essential advantages of the multi-functional apparatus according to the invention are that the power demand for the operation is considerably reduced since the drive means is the same for both the screening cylinder and the toothed disc element. Furthermore, the power demand for the rotating screening cylinder cooperating with stationary blades will be less than for a stationary screening cylinder cooperating with a rotor provided with blades. Installation is also simplified and space saved in the process plant. Similarly, the equipments for control and regulation as well as safety systems are reduced considerably. These improvements in turn result in considerable reduction of the operation, installation and material costs.

Since screening occurs from the outside and in, with the aid of the rotating screening cylinder and the stationary blades cooperating therewith inside the cylinder, any knots remaining are prevented from being broken by rapidly rotating blades and the reject is thus of better quality.

The apparatus is particularly suitable for assembly in a closed pressure system, e.g. in the blow pipe from a continuous pulp digester, to remove particles which may damage subsequent process machines. The fine fraction or accept flow thus obtained may then be conveyed for oxygen bleaching, for instance. The apparatus can thus be designed for use at any pressure above atmospheric generally occuring. A suitable speed for the toothed disc element and the shaft carrying the screening cylinder is about 1500 rpm for a pulp of medium concentration.

That which is claimed is:

1. An apparatus for dividing a suspension of fibrous cellulose pulp into a plurality of portions including an undesired parts portion and a remaining portion, the apparatus comprising a closed housing divided into first and second axially aligned chambers having a common longitudinal axis, each provided with inlet and outlet means; a separating means rotatable at high speed in said first chamber to separate the undesired parts portion from the suspension via the outlet means in said first chamber, the inlet means to the second chamber comprising an opening arranged between said first chamber and said second chamber for transferring the remaining suspension portion which has been substantially freed from undesired parts; a cylindrical screening means in said second chamber, connected to said separating means in said first chamber, the separating means and screening means being driven by a common shaft coincident with said longitudinal axis; and a support means in said second chamber provided with blades with which the screening means cooperates to divide the remaining suspension into different fractions which separately leave said second chamber by said outlet means of said second chamber.

2. An apparatus as claimed in claim 1 wherein said opening between the two chambers consists of an annular slot.

3. An apparatus as claimed in claim 2 wherein the annular slot is defined outwardly by a ring separating the two chambers, and radially inwardly by an opposite end portion of the screening means or.

4. An apparatus as claimed in claim 2 wherein the cross section area of the annular slot is less than the cross section are of the inlet to the first chamber.

5. An apparatus as claimed in claim 2 wherein the separating means comprises a disc element having a plurality of projections extending substantially radially and laterally aligned with said annular slot, said outlet in said first chamber located in the plane of the disc element, the undesired parts being separated from the suspension by said teeth during rotation of the disc element.

6. An apparatus as claimed in claim 5 wherein the radial extension of the annular slot is less than the radial extension of said projections, the annular slot being located concentrically within the radial extension of the projections and being covered by the projections in the axial direction.

7. An apparatus as claimed in claim 5 wherein the inlet to the first chamber is axially displaced in relation to the disc element.

8. An apparatus as claimed in claim 1 wherein the cellulose pulp being divided lies within the medium concentration range.

9. An apparatus as claimed in claim 1 wherein said apparatus is mounted in a closed pressure system.

10. An apparatus as claimed in claim 1 wherein said apparatus is provided with inlet means for the supply of diluting liquid to an injection side of the screening means.

11. An apparatus as defined in claim 2 wherein the annular slot is defined radially outwardly by a ring separating the two chambers, and radially inwardly by a circular disk arranged between the separating means and the screening means.

12. An apapratus for dividing a suspension of fibrous cellulose pulp into a plurality of portions including an undesired parts portion and a remaining portion, said apparatus comprising a closed housing divided into first and second chambers, each provided with inlet and outlet means; separating means rotatable at high speed in said first chamber to separate the undesired parts portion from the suspension via the outlet means in the first chamber, the inlet means to the second chamber comprising an opening arranged between said first chamber and said second chamber for transferring said remaining portion of the suspension to said second chamber means; a cylindrical screening means in said second chamber connected to said separating means in said first chamber, the separating means and screening means being driven by a common shaft; a support means in said second chamber provided with blades with which the screening means cooperates to divide the remaining suspension into different fractions which separately leave said second chamber by said outlet means of said second chamber; and said opening consisting of an annular slot defined radially outwardly by a ring separating the two chambers and radially inwardly by an opposite end portion of the screening means.

13. An apparatus for dividing a suspension of fibrous cellulose pulp into a plurality of portions including an undesired parts portion and a remaining portion, said apparatus comprising a clsoed housing divided into first and second chambers, each provided with inlet and outlet means the inlet means to the second chamber comprising an opening formed as an annular slot arranged between said first chamber and said second chamber for transferring said remaining portion of the suspension to said second chamber; separating means rotatable at high speed in said first chamber to separate the undesired parts portion from the suspension via the outlet means in the first chamber, wherein the separating means comprises a disc element having a plurality of projections which extend substantially radially and which are laterally aligned with said annular slot, and wherein said outlet means in said first chamber is located in the plane of the disc element, the undesired parts being separated from the suspension by said projections during rotation of the disc element; a cylindrical screening means in said second chamber connected to said separating means in said first chamber, the separating means and screening means being driven by a common shaft; and a support means in said second chamber provided with blades with which the screening means cooperates to divide the remaining suspension into different fractions which separately leave said second chamber by said outlet means of said second chamber.

14. An apparatus as claimed in claim 12 wherein the radial extension of the annular slot is less than the radial extension of said projections, the annular slot being located concentrically within the radial extension of projections and being covered by said projections in the axial direction.

15. An apparatus as claimed in claim 12 wherein the inlet to the first chamber is axially displaced in relation to the disc element.

16. An apparatus as claimed in claim 13 wherein the radial extension of the annular slot is less than the radial extension of said projections, the annular slot being located concentrally within the radial extension of said projections and being covered by said projections in the axial direction.

17. An apparatus as claimed in claim 13 wherein the inelt to the first chamber is axially displaced in relation to the disc element.

* * * * *